United States Patent [19]

Blacklin et al.

[11] 4,411,121

[45] Oct. 25, 1983

[54] STRUCTURAL MEMBER WITH TRUNCATED CONICAL PORTION AND COMPOSITE PANEL INCLUDING SAME

[75] Inventors: Peter A. Blacklin, Columbia; James R. Dougherty; Richard J. Johnson, both of Baltimore; Donald L. Tate, Millersville, all of Md.

[73] Assignee: Tate Architectural Products, Inc., Jessup, Md.

[21] Appl. No.: 230,671

[22] Filed: Feb. 2, 1981

[51] Int. Cl.[3] ..... E04C 2/32

[52] U.S. Cl. ..... 52/792; 52/630

[58] Field of Search ..... 52/792, 630, 806; 428/178

[56] References Cited

U.S. PATENT DOCUMENTS

| | | | |
|---|---|---|---|
| 2,391,997 | 1/1946 | Noble . | |
| 3,011,602 | 12/1961 | Ensrud et al. . | |
| 3,025,935 | 3/1962 | Ensrud et al. . | |
| 3,071,216 | 1/1963 | Jones et al. . | |
| 3,196,763 | 7/1965 | Rushton . | |
| 3,258,892 | 7/1966 | Rushton . | |
| 3,461,632 | 8/1969 | Kuhne | 52/792 X |
| 3,527,664 | 10/1970 | Hale . | |
| 3,876,492 | 3/1975 | Schott . | |
| 3,938,963 | 2/1976 | Hale | 52/792 X |
| 4,203,268 | 5/1980 | Gladden, Jr. et al. . | |

*Primary Examiner*—Carl D. Friedman

*Attorney, Agent, or Firm*—Oblon, Fisher, Spivak, McClelland & Maier

[57] ABSTRACT

A structural steel member and composite panel including the same and having a sheet of industrial steel having formed therein a pattern of dome-like projections, extending from the plane of the sheet, and of which at least the major portion of each projection is substantially circular in plan view and the projections are arranged in a geometric pattern that substantially limits the elongation of the material to the areas defined by the circular configurations, the dome-like projections also having formed in the peak areas thereof small truncated cones having a flattened uppermost planar surface, parallel to the original plane of said sheet, providing superior overall depth and increased resistance to crushing. When employed in the form of a composite panel, a flat load bearing steel sheet extends across and is fixed to the flattened surfaced of the peak areas, such as by welding, and affords advantageous union of the sheets to form such a composite panel, suitable for use, such as in the art of access flooring.

20 Claims, 14 Drawing Figures

STRUCTURAL MEMBER WITH TRUNCATED CONICAL PORTION AND COMPOSITE PANEL INCLUDING SAME

BACKGROUND OF THE INVENTION

1. Field of the Invention

The present invention essentially comprises an improvement over prior U.S. Pat. No. 4,203,268 issued May 20, 1980, and the present inventors include two of the patentees of the invention covered by such patent.

2. Description of the Prior Art

In the ever present search for ways to minimize cost of producing various objects, savings in the amount and cost of material used therein is a fruitful area to effect savings, especially if quality of the product can be maintained or increased. Constant increases in the cost of steel has given rise to seeking ways to reduce the amount of steel used especially in the access floor panels to which said prior patent primarily pertains.

From an engineering standpoint, when two sheets of steel are attached in parallel but vertically spaced relation to constitute a composite panel unit in which the upper sheet is flat and is subjected primarily to compression, while the lower one is subjected to primarily to tension, the greater the distance between said sheets, the thinner at least the lower tension sheet can be.

In the prior U.S. Pat. No. 4,203,268 such spacing of the compression and tension sheets is effected advantageously by employing circular dome-like projections as shown in FIG. 1A extending upwardly from the bottom tension sheet and welding the uppermost curved section of each dome to the top compression sheet, the projections being arranged in certain advantageous geometric patterns. This arrangement afforded certain advantageous resistance to deflection of the panels due to static or mobile loads, while minimizing the thickness of the sheets to afford acceptable operational requirements and specifications. The search for further savings in materials never ceases, however, and the present applicants know that increasing the depth or space between the compression and tension sheets in the composite structural unit will improve resistance to flexure and thus allow for reductions in material required. It was also known that as the depth of the dome-like projection is increased, the material thins due to stretching and consequently the resistance to crushing is lessened. In addition the applicants know that an optimum shape to resist crushing is a truncated cone as shown in FIG. 1B. It has been discovered, however, that a combination can be provided in the dome-like projections, as illustrated in the aforementioned patent, which provides increased overall depth as well as resistance to crushing. This resistance to crushing can be increased by forming a substantially flat surface on the uppermost peak of the projections of a diameter much less than that of the circular domes.

The truncated cone provides a larger area of support to distribute the load, thus allowing thinning of material due to providing increased depth by stretching without detrimentally affecting the ability of the dome to resist crushing.

The mere use of flat surfaces on the peaks of circular or other shapes of pyramidal type spacing members between parallel structural sheets is old, as shown by the following prior U.S. Patents:

U.S. Pat. No. 2,391,997, Noble, Jan. 1, 1946

U.S. Pat. No. 3,011,602, Enstrud et al., Dec. 5, 1961
U.S. Pat. No. 3,025,935, Enstrud, Mar. 20, 1962
U.S. Pat. No. 3,071,216, Jones et al., Jan. 1, 1963
U.S. Pat. No. 3,196,763, Rushton, July 27, 1965
U.S. Pat. No. 3,258,892, Rushton, July 5, 1966
U.S. Pat. No. 3,527,664, Hale, Sept. 8, 1970
U.S. Pat. No. 3,876,492, Schott, Apr. 8, 1975

It was found that such use of truncated cone arrangements as employed on the above listed patents greatly limits the height of such cones, even though having flat peak surfaces. Hence, the invention of prior U.S. Pat. No. 4,203,268 was recognized as being patentable over that type of spacing members, due to the use of dome-like projections, especially to resist crushing, together with effective dimensional spacing to minimize the thickness of the sheets and especially the tension sheet.

It has now been discovered by the present applicants that combining the advantages of the depth obtainable by using a dome-like projection, and further including a truncated cone with the flat plane parallel to the original plane of the sheet serves to greatly increase resistance to crushing and provides improved assembly and these improvements also provide a basis for conditions, further effecting a highly desirable increase in the overall height of the projections by structural changes described hereinafter, whereby still further savings may be achieved, in particular, by decreasing the thickness of at least the lower tension sheet.

SUMMARY OF THE INVENTION

It is therefore the object of the present invention to provide this combination of improvements in a sheet of structural material to form a tension sheet, as well as a composite structural panel including the same therein.

It is among the principal objects of the present invention to provide a sheet of structural material having formed therein a pattern of dome-like projections extending from the plane of the sheet and arranged in a strategic geometric pattern, such projections including in the peak areas, thereof, a relatively small truncated cone extending upward and having the upper flattened planar surface parallel to the original plane of the sheet to further increase the overall effective height of the projections to increase strength to weight ratios.

Another important object of the invention is to provide the truncated cone with smoothly rounded edges where the flat surface is connected to the side wall of the cone and said sidewall is connected to the peak of the dome, all in a manner to provide maximum resistance to crushing.

A still further object of the invention is to form the dome-like projections initially in the structural sheet by forming and stretching the sheet only in the areas occupied by the dome, and then forming the truncated cones in the uppermost surfaces of the dome-like projections by further stretching the uppermost surfaces of the domes to include a flat uppermost surface in the truncated cone, the base of which provides a larger area of support to distribute the load to the portion of the dome which surrounds the truncated cone.

It is still another object of the invention to form the substantially circular wall of each truncated cone so as to be substantially S-shape in cross-section and thereby provide increased resistance of the truncated cone to crushing by applied compressive loads.

A still further object of the invention is to form a structural unit comprising a flat sheet fixedly connected to the flat top surfaces of the aforementioned truncated cones on the dome-like projections and thereby utilize the increased depth of the domes to improve the resistance of the structural unit to deflection by applied loads when the flat sheet is substantially subjected to compression and the sheet embodying the dome-like projections is subjected substantially to tension.

An additional object of the present invention is to provide a sheet wherein the ratio of the diameter of the flattened uppermost surface of the truncated cone to the diameter of the dome-like projection is from 1:16 to 1:2 inclusive and the ratio of the overall depth from the base of the truncated cone to the plane of the sheet to the diameter of the dome-like projection is from 1:4.28 to 1:2.14 inclusive.

It is still another object of the invention to arrange said dome-like projections in said sheet of structural material in a pattern in which rows of equally spaced pairs of in-like properties are interwoven perpendicularly with others such rows of pairs in a basket weave fashion so that the portion of a centerline of a row of pairs of projections that lies between two aligned pairs bisects the pairs thereof in transverse rows and has sufficient density to block straight lines of clear vision repeatedly in all directions across the sheet to form a one piece rigid structural member capable of resistance to flexure and the portions of the member which are intermediately between the projections including continuous structural ribbon like stress sections of fluctuating width and arcuate in plan view capable of optimizing stress resisting integrity.

One further object of the invention ancillary to the foregoing objects is also to arrange the dome-like projections combined in groups of four arranged in a rhombus pattern and adjacent rhombus patterns being positioned in close perpendicular basket weave orientation and thereby locating the projections to repeatedly block said clear lines of vision as aforesaid.

A still further object is utilization of this composite structural member in the fabrication of access floor panels wherein the perimeter of the structural member has the outer edge portions formed at right angles to the member to provide a continuous bracing flange around the panel of a given finite size to provide a panel which can be selectively supported at the edges of corners thereof and which can accept substantially uniform or concentrated loads, such as those seen in access flooring applications.

A still further object of the invention is to provide an integral perimeter lip bent outward from said peripheral bracing flange to provide an additional connection between the member and the top sheet which is utilized as a stiffened lip by which the access floor panel can be selectively supported at the corners or along the perimeter to develop an access floor system in combination with pedestals and/or stringers.

A still further object of the invention is to provide the peripheral bracing flange with a greater transverse depth relative to the intermediate portion of the structural member between the projections, and in which the depth is greater than the height of the projections and a portion extending in the opposite direction from the projections and another portion extending in the same direction as the projections to provide a perimeter of increased strength and resistance to flexure, especially when utilized as an access floor panel without the use of secondary members, such as stringers or more complicated panel-to-panel hard connecting devices to prevent edge-to-edge movement.

Another object is to form said structural member in such manner that all surfaces of the projections and the junctures thereof with the intermediate structural stress sections in the original plane of the sheet are free from sharp edges or bends whereby there are no areas or portions in the sheet which include corners or other shapes which normally tend to pucker or otherwise resist formation of smoothly stretched areas when formed from planer sheets and subjected to shaping by dies.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIG. 3 is a plan view of a fragment of a structural member embodying the principles of the present invention in which one embodiment of dome-like projections with truncated cones are formed, said figure illustrating diagrammatically broken lines tracing arcuate structural stress sections of said member, which are ribbon-like;

DETAILED DESCRIPTION

Figure 1A:
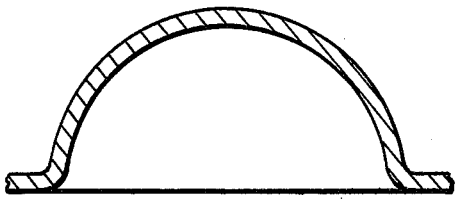
FIG. 1A PRIOR ART
FIGS. 1A and 1B show conventionally shaped sheet projections.
Figure 1B:
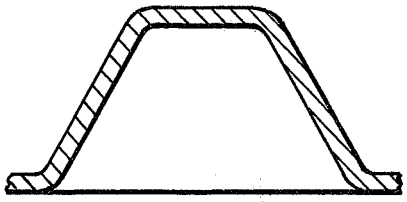
FIG. 1B PRIOR ART

The most important part of the present invention comprises a one-piece structural member formed from a sheet of industrial material which, preferably comprises metal, such as steel, for example, but for certain applications of the invention, other industrial material, such as certain plastics, may be employed. Particularly when made from metal, a sheet of such industrial materials is subjected to appropriate punches and dies respectively for forming a plurality of any one of a number of different shapes, kinds, and patterns of projections, details of which are described hereinafter, said projections preferably extending from one surface of the sheet of material and all the upper ends of said projections preferably being substantially within the same plane. Except for the integral edge construction which may be formed simultaneously from within said sheet, all surfaces of the major portion of the sheet are smoothly curved and are free from sharp angles or bends which otherwise would comprise corners or other shapes which normally tend to pucker or resist formation of smoothly stretched areas when formed from a planar sheet and subjected to shaping by such punches and dies. Except for the possibility of forming a limited number of holes or openings in the sheet, such as for the transmission of air in certain applications of the invention, the formed sheet is substantially imperforate.

To provide an understanding of certain terms used in the specification and claims of this application, the following definitions are set forth:

DEFINITIONS

1. Truncated Cone—A cone having the apex replaced by a plane section especially by one parallel to the base.

2. Peak Areas—The areas of the dome-like projections near the top of the projection that are nearly parallel to the original plane of the sheet prior to forming.

3. Flattened Uppermost Surface—The surface developed at the top of the truncated cone on the dome-like projection which is parallel to the original plane of the sheet prior to forming and which has been set in orientation by coining of the material between a punch and die for optimum performance in resistance to crushing.

4. Resistance to Crushing—Ability of a structural member to accept compressive loads without yielding locally or catastrophically throughout the structure.

5. Stress Section—The portion of the structural member between the projections designed to withstand tensile and compressive stresses.

6. Structurally Strategic Geometric Pattern—The dimensional relationship and orientation of projections in which the following five major characteristics are strategically interrelated;

1. depth of projection for needed section modulus and moment of inertia;
2. diameter of projections to obtain needed depth;
3. distance between the centerlines of projections for adequate top sheet support;
4. strategic positioning of projections to repeatedly block clear lines of vision throughout the member; and
5. remaining bottom surface material adequate to perform as a stress member and also provide necessary section modulus and moment of inertia.

7. Structural Unit—A unit of two or more members, which when combined provide a substantial increase in section modulus and strength-to-weight ratio over these same properties of the individual members.

8. Substantially hemispherical dome-like projections—projections having radiused contours in all directions of one or a combination of radii to provide arches for top sheet support and to develop optimum height for increased section modulus.

9. Fixedly secured—Any means causing two members to work together as a composite unit, such as welding, riveting, use of structural adhesives, direct fusion or other known methods.

10. Optimization of Support—providing specific density of projections in a base sheet of material, such that they prevent localized indentation of the top sheet when used as a composite unit, providing frequency of load transfer from the top sheet to the structural member and minimizing top sheet thickness while optimizing strength-to-weight ratio of the unit.

11. Straight Lines of Vision—visible longitudinal openings providing direct open paths through a composite section around which the section can bend or flex and through a member around which the member can flex. Increased frequency of blockage is directly proportional to increased resistance to flexure.

12. Rhombus Pattern—geometric pattern of an equilateral parallelogram having oblique angles wherein the centers of the projections are located at corners of a rhombus.

13. Basket weave orientation—the combination of patterns of pairs of projections or elongated configurations interlaced or intermeshed and in which one pattern is perpendicular to an adjacent pattern so that a straight line of sight therebetween is intercepted, thus providing a unique pattern of location and density for sufficient top sheet support and optimum strength-to-weight ratio.

14. Arcuate structural stress members—stress members between the projections of the sheet, sinuous in shape and held in their configuration when under stress by the circular ends by the projections acting to resist deformation and tendency to straighten.

15. Continuous Bracing Flange—the edge termination of a member of finite size and perpendicular thereto which provides continuous built-in means of edge stiffening.

16. Peripheral Lip—the return of the outermost edge portion of the continuous bracing flange to dispose it in the same plane as the terminal ends of said projections and when affixed to a top sheet, provides a means of selectively supporting a panel at the corners and/or edges thereof.

17. Greater transverse depth—additional depth provided at the edge termination of a member of finite size, the depth being deeper than the projections and providing added edge stiffness.

18. Isotropic—load-resisting properties of a composite unit having substantially the same values when measured along axes in all directions and which is substantially free from directional weakness when the unit is penetrated by holes, cutouts, and the like.

19. Structural Efficiency—the efficient design and utilization of structural components in such a way as to permit the use of shallower sections and thinner materials in lieu of deeper sections and heavier materials while developing equal or better moment of intertia and/or more balanced section modulus. Relative structural efficiencies of two units expressed as a percentage, the units under the same load and support conditions, is determined by the following formula:

$$\frac{\text{Deflection Unit \#1}}{\text{Deflection Unit \#2}} \times \frac{\text{Mass weight Unit \#1}}{\text{Mass weight Unit \#2}} \times \left(\frac{\text{Section depth Unit \#1}}{\text{Section depth Unit \#2}}\right) \times 100$$

20. Hoop Stress—Tensile or compressive stress in a circular member acting circumferentially. Because of symmetry of the member, there is no tendency for any part of the circumference to depart from the circular form under load as long as the hoop stress remains below the yield point of the material.

21. Directional Weakness—appreciable loss of strength in a structural unit caused by planes of flexural weakness that are developed by penetration of the structural unit and around which planes the unit readily flexes relative to flexture in other directions.

22. Strength-to-Weight Ratio—ratio of the mathematical product of deflection times mass for one unit compared to the same ratio for a second unit. The strength-to-weight ratio is used to determine minimum weight consistent with the geometry of the unit required to maintain the integrity of the unit to resist flexure. Relative strength-to-weight ratios of two units expressed as a percentage—said units under the same load and support conditions is determined by the following formula:

$$\frac{\text{Deflection Unit \#1}}{\text{Deflection Unit \#2}} \times \frac{\text{Mass weight Unit \#1}}{\text{Mass weight Unit \#2}} \times 100$$

23. Substantially circular in plan view—being circular or of similar shape in general while providing ability to obtain optimum depth.

DETAILED DESCRIPTION OF THE PREFERRED EMBODIMENTS

Figure 2:
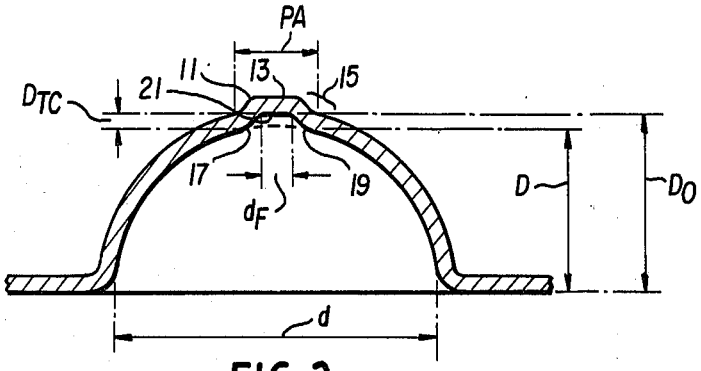
FIG. 2 shows a cross-section of the sheet with a dome-like projection having a truncated cone in accordance with the present invention.

Referring initially to FIG. 2 shown therein is a cross-sectional view of a sheet 10 with a dome-like projection 12 having a truncated cone 11 formed in a peak area thereof. Sheet 10 includes a pattern of dome-like projections 12 extending from the plane of sheet 10 and wherein at least a major portion of the configuration of each dome-like projection 12 is substantially circular in plan view.

Figure 4:
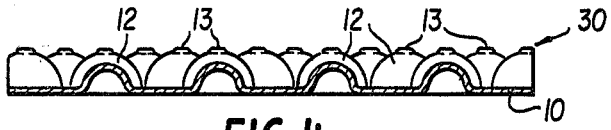
FIG. 4 is a fragmentary vertical sectional view of the structural member shown in FIG. 1, as seen on the line IV—IV thereof.
Figure 5:
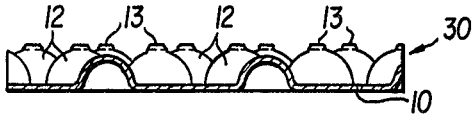
FIG. 5 is a fragmentary sectional view similar to FIG. 4 but showing the cross-section of the member shown in FIG. 1, as seen on the line V—V thereof.

The dome-like projections 12 in the plane of sheet 10 are shown in FIGS. 4 and 5, for example, as being arranged in a geometric pattern that limits the elongation of the material to the areas defined by the substantially circular configurations. Each of the dome-like projections 12 has a truncated cone 11 formed in the peak area thereof and includes a flattened uppermost surface 13 parallel to the plane of sheet 10 so as to increase overall depth and resist crushing as well as facilitating assembly of the sheet.

A circular wall portion 15 serves to connect planar flattened uppermost surface 13 of the truncated cone 11 to an adjacent upper portion of dome-like projection 12 from which truncated cone 11 is distended. Circular wall 15 is substantially S-shaped in cross-section and developes a distinctness of contour which is established such that it provides an additional depth $D_{TC}$ and transfers compressive loads from the flattened uppermost surface 13 of truncated cone 11 to a portion 17 of dome-like projection 12 surrounding a base portion 19 of truncated cone 11 to the extent that experiments have shown that the first yielding in compression occurs in the portion 17 of the dome-like projection 12 surrounding the truncated cone 11. Peak area PA is shown as being nearly parallel to the original plane of sheet 10.

In accordance with the present invention, it has been determined that the functional dimensional relationships of various features of the dome-like projection and truncated cone 11 are such that the ratio of the diameter $d_F$ of the flattened uppermost surface 13 of the truncated cone 11 to the diameter d of the dome-like projection 12 is from 1:16 to 1:2 inclusive. Furthermore, the functional ratio of the overall depth $D_o$ from the lower surface 21 of truncated cone 11 to the plane of sheet 10 to the diameter d of the dome-like projection has been determined to be from 1:4.28 to 1:2.14 inclusive. D represents the distance from base 19 of truncated cone 11 to the plane of sheet 10. As an example, the range of thickness of sheet 10 in FIG. 2 can be from 0.03" to 0.060" while $d_F$=0.375", D=0.890", $D_{TC}$=0.040" and d=2.125".

Figure 3:
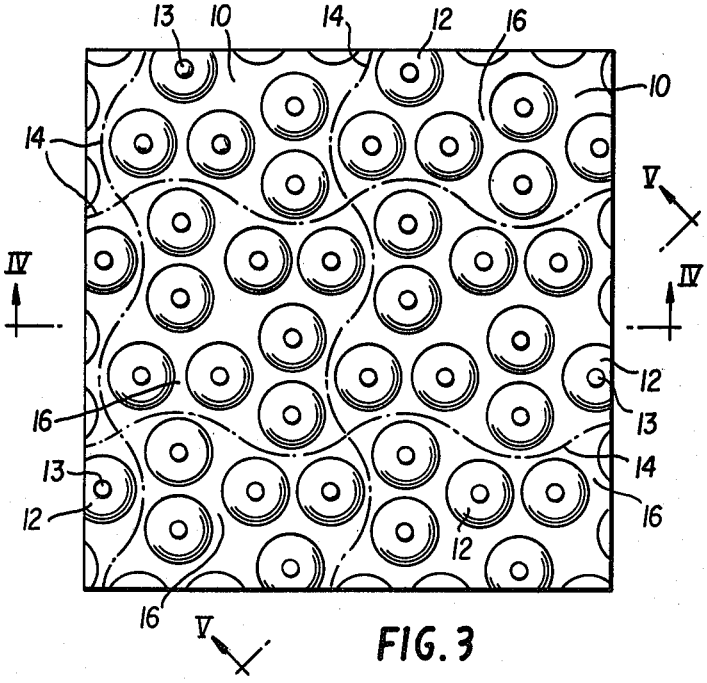

Referring to FIG. 3, there is shown therein a fragmentary section of sheet 10 of structural material, which initially is planar and the same is subjected to a set of dies to form therein the plurality of projections 12 which, as will be seen from FIGS. 4 and 5, are dome-shaped and are substantially circular in plan view. This arrangement provides one embodiment of projections which adapts itself as being disposed in patterns, such as shown in one exemplary manner in FIG. 3, in which the projections are in close relationship to each other and therefore, are frequently disposed throughout the sheet, in rows of pairs of equally-spaced in-line projections that are interwoven perpendicularly in basket weave fashion, and as further illustrated diagrammatically by dotted lines in FIG. 10, the portions of a centerline of a row of pairs that lies between two aligned pairs bisects the pairs thereof in rows transverse thereto. Such projections are spaced a limited distance from each other so as to provide therebetween sections of the original sheet which are arcuate as indicated by the exemplary, somewhat sinuous diagrammatic line 14, which outlines the intermediate continuous planar structural ribbon-like stress sections 16 of the original sheet 10.

Figure 11:
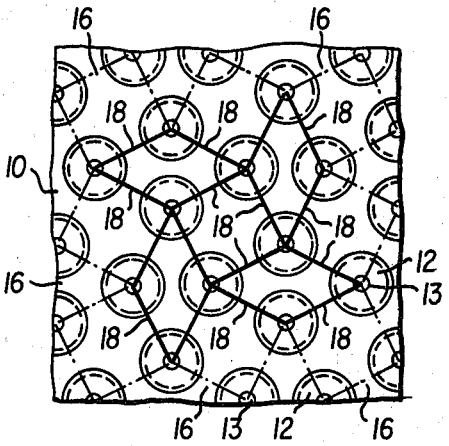
FIG. 11 is a diagrammatic view of a section of a structural member similar to that shown in FIGS. 2–5 and illustrating by outline, rhombus figures extending between the centers of clusters of four projections and the pattern of said outline illustrating a basket weave pattern in which said clusters of projections are disposed.
Figure 10:
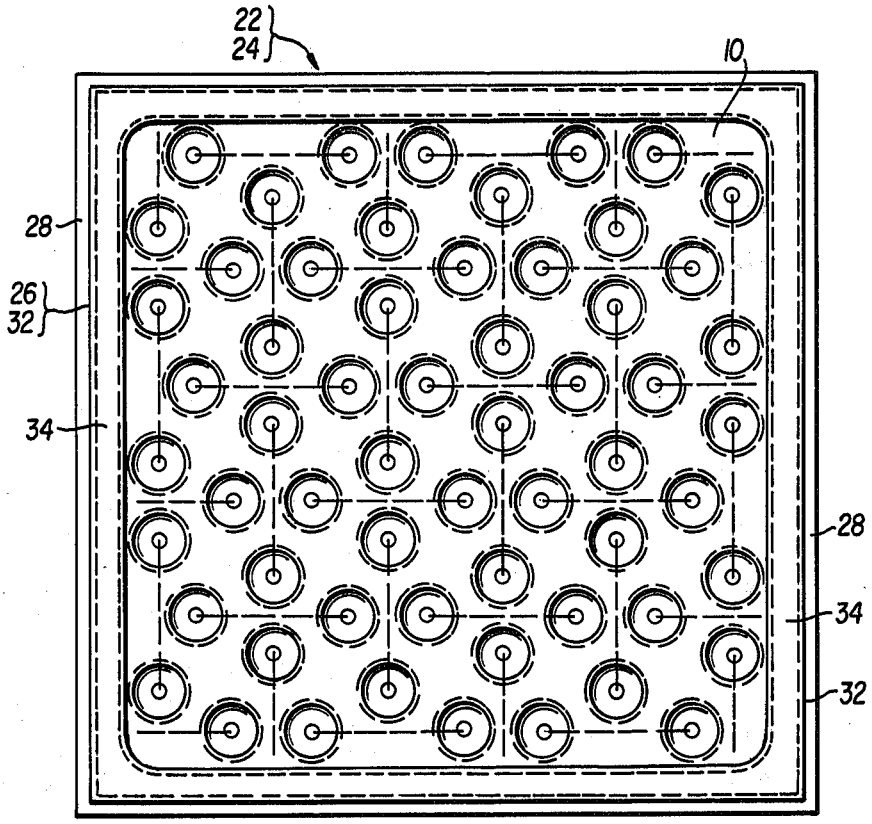
FIG. 10 is a bottom plan view of another embodiment of panel similar to that shown in FIGS. 3–7 and in which the structural member shown in said figures has been included in said panel, said view also showing diagrammatically the portions of centerlines of a row of pairs of projections that lie between two aligned pairs bisecting the pairs thereof in transverse rows in the perpendicular basket weave arrangement of rows of pairs of said projections.

It also will be observed from FIG. 3 that the projections 12 are arranged in the sheet in such manner that only a limited number, such as pairs of evenly spaced projections are disposed in what might be considered a straight line and, preferably, the projections are disposed in patterns in which a preferred arrangement, such as a perpendicular basket weave configuration, shown diagrammatically in FIG. 10, which also, as shown in FIG. 11, constitute rhombus configurations denoted by the diagrammatic patterns 18 which extend between the centers of the projections 12, and it will be seen that said patterns touch each other at points, whereby the illustration clearly shows the relatively saturated occurrence of the projections 12 within the sheet 10, while at the same time, permitting the occurrence of the intermediate stress sections 16 between the individual, adjacent projections 12. Most importantly, however, it will be seen that the patterns 18 of the projections 12 comprise a structurally strategic geometric pattern of a density which repeatedly blocks straight lines of clear vision in all directions across the sheet and thereby, in accordance with a major objective of the present invention, this feature provides maximum rigidity to the structural member including sheet 10 with the projections 12 formed therein due to the interrelationship of the diameter of the projections and the center-to-center distance between adjacent projections.

Figure 6:
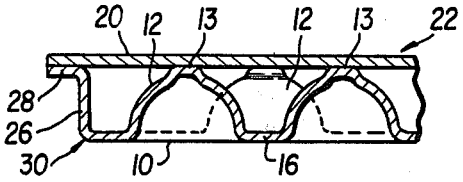
FIG. 6 is a fragmentary sectional view of a panel embodying the structural member shown in FIGS. 3–5 but to which a fragmentarily illustrated section of a top planar sheet has been affixed and said illustration being on a larger scale than in the preceding figures.
Figure 7:
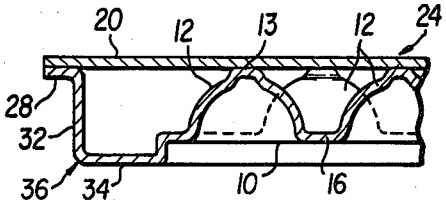
FIG. 7 is a fragmentary vertical sectional view similar to FIG. 6 but illustrating another embodiment of reinforcing flange from that shown in FIG. 6.

Another advantage of forming the projections 12 in dome-like configuration of a thickness no greater than that of the original sheet is that the same are readily capable of being formed to a substantial height from the original plane of the sheet 10 in which, for example, the intermediate stress sections 16 are disposed as shown in exemplary manner in FIG. 6, and also in FIG. 7, whereby the uppermost portions of the projections 12 are thinner than the lower portions thereof, while the intermediate stress sections 16 preferably retain optimum material, therby providing maximum stress-resisting capabilities. Further, the formed structural member comprising the sheet 10 with the projections 12 formed therein may be produced by a simple form die arrangement. The shape of the projections 12 also is capable of being formed without rupture or shearing and, if desired, the resulting product may be imperforate. However, particularly when the structural member is employed in either a structural unit or finished structural panel through which, for example, cable cutouts or the like are desired, the structural member per se may be provided with suitable openings of limited diameter in appropriate locations through both the intermediate stress sections 16 or the outer ends, for exampled, of the projections 12, when desired, without detracting from the stress-resisting capabilities of the structural member, due to the isotropic properties of the unit.

In most applications of the invention, the structural member comprising the sheet 10 and the projections 12 formed therein is combined with a second planar sheet 20. Due to the fact that the flattened uppermost surface 13 of the projections 12 are substantially within a common plane, when the sheet 20 is abutted commonly with flattened upermost surface 13, it may be secured to said upper ends by any appropriate means, such as welding, rivets, industrial adhesives, direct fusion, or any other known means of suitable nature, by which the planar sheet 20 is fixedly connected to flattened uppermost surface 13. This results in producing a structural unit which finds a most useful application when formed into a composite panel, several preferred embodiments of which are illustrated fragmentarily respectively in FIGS. 6 and 7 in vertical section and, correspondingly, and respectively, in FIGS. 8 and 9, in which fragmentary corners of a composite structural panel 22 of one embodiment, and a second embodiment 24 thereof, are shown in bottom plan view.

To form said composite panel, the edges of a finite shape and size of the sheet 10 with the projections 12 therein are bent upwardly at a right angle to form a reinforcing bracing flange 26 which has the same vertical dimension as the height of the projections 12 and truncated cones 11 and, additionally, in the embodiments shown in FIGS. 6–9 and 10, the terminal edge portion of the bracing flange 26, which is continuous around all four sides of the composite panel, is bent outwardly at a right angle thereto to form preferably a continuous lip 28, the upper surface of which is in a plane common with that of the upper ends of the projections 12, whereby the second planar sheet 20 commonly abuts the upper surface of the lip 28 and the flattened uppermost surface 13 of each truncated cone 11 of the projections 12, it being understood that the planar sheet 20 also will be of substantially the same finite shape and size as that of the embodiment of structural member 30 to which it is fixedly connected.

As can be visualized from the illustration of the occurrence of the projections 12 within the sheet 10 of the structural member 30, especially as seen from FIG. 3, there is very frequent support afforded the second planar sheet 20, whereby a sheet of substantially reduced thickness may be utilized and still permit the same to afford resistance to indentation even by localized loads when applied to the planar sheet 20 of the composite structural panel 22 and the structurally strategic geometric pattern which embodies the unique relationship between the diameter of the projections and the center-to-center distance therebetween so as to provide increased resistance to deflection relative to strength-to-weight ratio and structural efficiency, even when subjected to substantial loads of either a uniform or concentrated nature.

Figure 8:
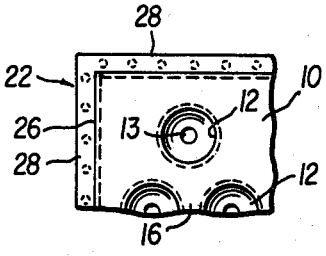
FIG. 8 is a fragmentary bottom plan view of a corner of the panel illustrated in FIG. 6 but shown on a smaller scale than employed in said figure.
Figure 9:
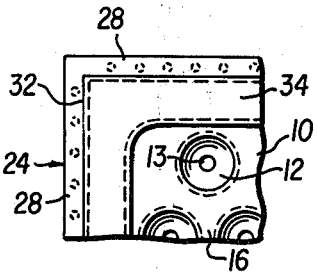
FIG. 9 is a view similar to FIG. 8 but showing a corner of the panel illustrated in FIG. 7 and using a smaller scale than employed in FIG. 7.

Referring to FIGS. 7 and 9, the composite structural panel 24 shown therein is similar to the panel shown in FIGS. 6 and 8, except that the bracing flange 32 thereof is of a greater depth than the height of the projections 12 and this is formed by means of depressing the peripheral sections 34 of the additional embodiment of structural member 36 from the remaining portions of the basic sheet 10 in a direction opposite to that from which the projections 12 extend, thereby producing a portion which extends oppositely to projections 12 and said bracing flange 32 is another portion which extends in the same direction as the projections 12 and is of greater vertical dimension than the flange 26 in the embodiment of FIG. 6. The resulting composite structural panel 24, shown in FIGS. 7 and 9 particularly adapts this embodiment of structural panel to provide support, especially by the corners thereof. This eliminates the need for supporting stringers between suitable pedestals, which, for example, are required in an elevated floor such as a so-called access floor in which a plurality of such structural panels are employed as floor panels and, under which circumstances, many available structural panels presently in use do not have the required rigidity along the edges thereof.

Notwithstanding the fact that the intermediate stress sections 16 of the embodiments of the invention shown in the foregoing figures are arcuate and somewhat sinuous in plan view, said stress sections are maintained in said configuration and are capable of not being moved therefrom when subjected to stress due to the fact that the circular configuration of the projections 12 in cross-section converts load stress to hoop stress adjacent to the opposite sides of said stress section. As can be seen, especially from FIG. 3, the arcuate intermediate stress sections 16 extend substantially around all sides of the circular projections 12 and thereby utilize the hoop stress property of such projections advantageously for the stated purpose with respect to the stress sections 16.

A more comprehensive concept of the several embodiments of composite panels is represented and illustrated in the several embodiments shown in the preceding figures. Attention is directed to FIG. 10, in which the composite structural panels 22 and 24 are shown in bottom plan view.

A rhombus arrangement having a basket weave pattern can be visualized from the diagrammatic illustration of FIG. 10 in which pairs equally spaced separate projections, also shown in FIG. 3, are illustrated in such basket weave pattern in which rows of pairs of equally-spaced-in-line projections are interwoven perpendicularly relative to each other in such manner that the portion of a centerline of a row of such pairs of projections that lies between two aligned pairs bisects the pairs thereof in transverse rows.

For certain applications of the invention, it is conceivable that a pair of any of the above-described structural members may be disposed in abutting relationship with the projections 12 disposed in axial alignment fixedly connected together to provide composite structural members having very substantially rigidity and ability to resist flexure when loads are applied against either of the outer surfaces thereof.

Figure 12:
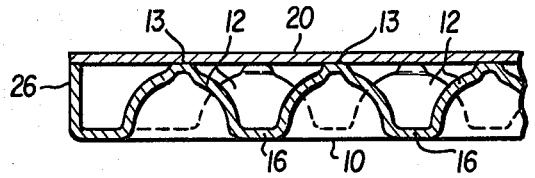
FIG. 12 is a fragmentary sectional view of a structural unit similar to FIG. 6 but in which the bracing flange is shown abutting the top sheet adaptable for direct connection thereto.
Figure 13:
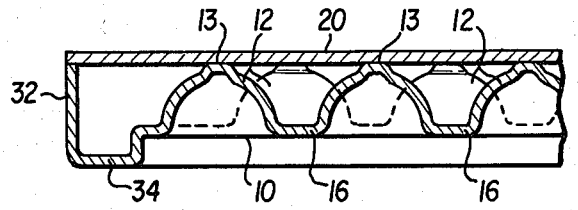
FIG. 13 is a view similar to FIG. 12 but in which the depth of the flange is greater than the height of the projections.

Still another embodiment of the invention is illustrated in FIGS. 12 and 13. This embodiment comprises terminating the bracing flanges 26 and 28 in these respective structural members and composite structural panels at the upper ends and omit the lip 28 thereon, thus butting the upper ends of the flanges directly against the adjacent surfaces of the top planar sheets 20 in said members and panels and connecting said upper ends of the flanges fixedly to the perimeters of said top planar sheets which also terminate at the vertical plane of the outside surfaces of said bracing flanges, as clearly shown in FIGS. 12 and 13. Under such circumstances, when the structural panels thus formed are used in an access floor, the outer surfaces of said bracing flanges of adjacent panels closely interfit in the overall access floor.

From the foregoing, it will be seen that the present invention provides a plurality of embodiments of structural panels which include the same and in which such panels are relatively of light weight and embody optimization of support by utilizing the most effective strength-to-weight ratio and structural efficiency and embodying maximum resistance to deflection, as well as resistance to indentation of the planar top sheet of such panels due to the frequency of structural support therefor by projections in the structural members included therein. For maximum support of the planar sheets 20 by projections 12 having truncated cones 11 in the sheet 10, it will be seen in the various illustrated embodiments that additional single projections not comprising parts of pairs thereof or of the basket weave patterns or rhombus configurations are included in the sheets 10 and are similar to the projections in the patterns thereof to occupy areas of sheet 10 which would otherwise not offer desired support to the planar sheets 20 of the composite structures and structural units of the invention.

TEST DATA

To demonstrate the significantly improved characteristics and performance of the present invention, comparisons have been made with access floor panels disclosed in prior art and commercially available especially those discussed in prior U.S. Pat. No. 4,203,268. Comparisons have been made on a "strength-to-weight" basis, a "structural efficiency ratio" basis of the structural unit and on the resistance to crushing each described more fully below. The existing prior art panel has comparable resistance to flexure when loaded either at the center of the panel and/or at the midspan of the perimeter, but which require significantly greater material by weight and/or depth of section. For the prior art panel to have comparable performance, it would require additional material and/or greater depth of section, thus demonstrating lower overall structural efficiency which is needed to develop required moment of inertia. By combining material mass weight savings, thinner depth of section, and deflection performance, the panels of the present invention demonstrate a marked improvement in actual structural efficiency. In the instance of the edge, the improvement is in excess of 21%.

Strength-to-weight ratio, in the context of the present invention, is used to relate deflection under a given load to the mass weight of the material. Expressed as the following formula:

$$\frac{\text{Deflection Unit \#1}}{\text{Deflection Unit \#2}} \times \frac{\text{Mass weight Unit \#1}}{\text{Mass weight Unit \#2}} \times 100$$

the result is a numerical performance ratio, expressed as a percentage of access floor unit #1 (prior art) to access floor unit #2 (present invention).

Data employed in the formula for the present invention is an average of 3 random samples taken from a test run, and data for the panel of the prior art was derived for U.S. Pat. No. 4,203,268.

The "structural efficiency ratio" is a comparative ratio that relates deflection, mass weight, and section depth. In essence, it is a measure of the efficiency of the panel section in its utilization of the mass of the material. Expressed as the following formula:

$$\frac{\text{Deflection Unit \#1}}{\text{Deflection Unit \#2}} \times \frac{\text{Mass weight Unit \#1}}{\text{Mass weight Unit \#2}} \times \left(\frac{\text{Section Depth Unit \#1}}{\text{Section Depth Unit \#2}}\right)^2 \times 100$$

the result is a numerical structural efficiency ratio, expressed as a percentage of access floor unit #1 (prior art) to access floor unit #2 (present invention). As before, the data employed in the formula for the present invention is an average of three sample panels taken from a test run and the data for the prior art panel was derived for U.S. Pat. No. 4,203,268.

The test method was identical for all panels tested. Three panels were selected at random from a test run of panels of the present invention and were tested. Each panel was placed on rigid pedestal supports without the use of edge stringers. Concentrated loads of identical magnitude were applied to the center of the panel and at mid-span of the perimeter. Deflection readings were recorded from the bottom of the panel directly under the load. All panels were reloaded with deflection recorded again. On each loading sequence, the permanent set was also recorded.

The following chart expresses relative "strength-to-weight" and "structural efficiency" ratios. The differences in these parameters are stated as a percentage improvement of the performance of panels of the present invention. it is to be noted that the present invention had performances superior to the prior art panel. As a base, the average weight of the panels of the present invention was $17\frac{1}{4}$ lbs.

| REF PATENT NO. | INDUSTRY IDENTI-FICATION | SAMPLE PANEL WEIGHT | EDGE STRENGTH TO WEIGHT RATIO* | EDGE STRUCTURAL EFFICIENCY RATIO* | CENTER STRENGTH TO WEIGHT RATIO* | CENTER STRUCTURAL EFFICIENCY RATION* |
|---|---|---|---|---|---|---|
| U.S. PAT. NO. 4,203,268 to GLADDEN et al May 20, 1980 | TATE ARCHI-TECTURAL | 20.25 | +5.3% | +21.2% | +0.96% | −7.8% |

*percentage change

As can be seen from the data, the present invention demonstrates a dramatic improvement in overall structural efficiency and strength-to-weight ratios especially on the edge over the prior art panel. The present invention offers a reduction in material usage over the panel to which it was compared. It also provides improved resistance to flexure when loaded and utilized as an access floor panel.

Figure 14:
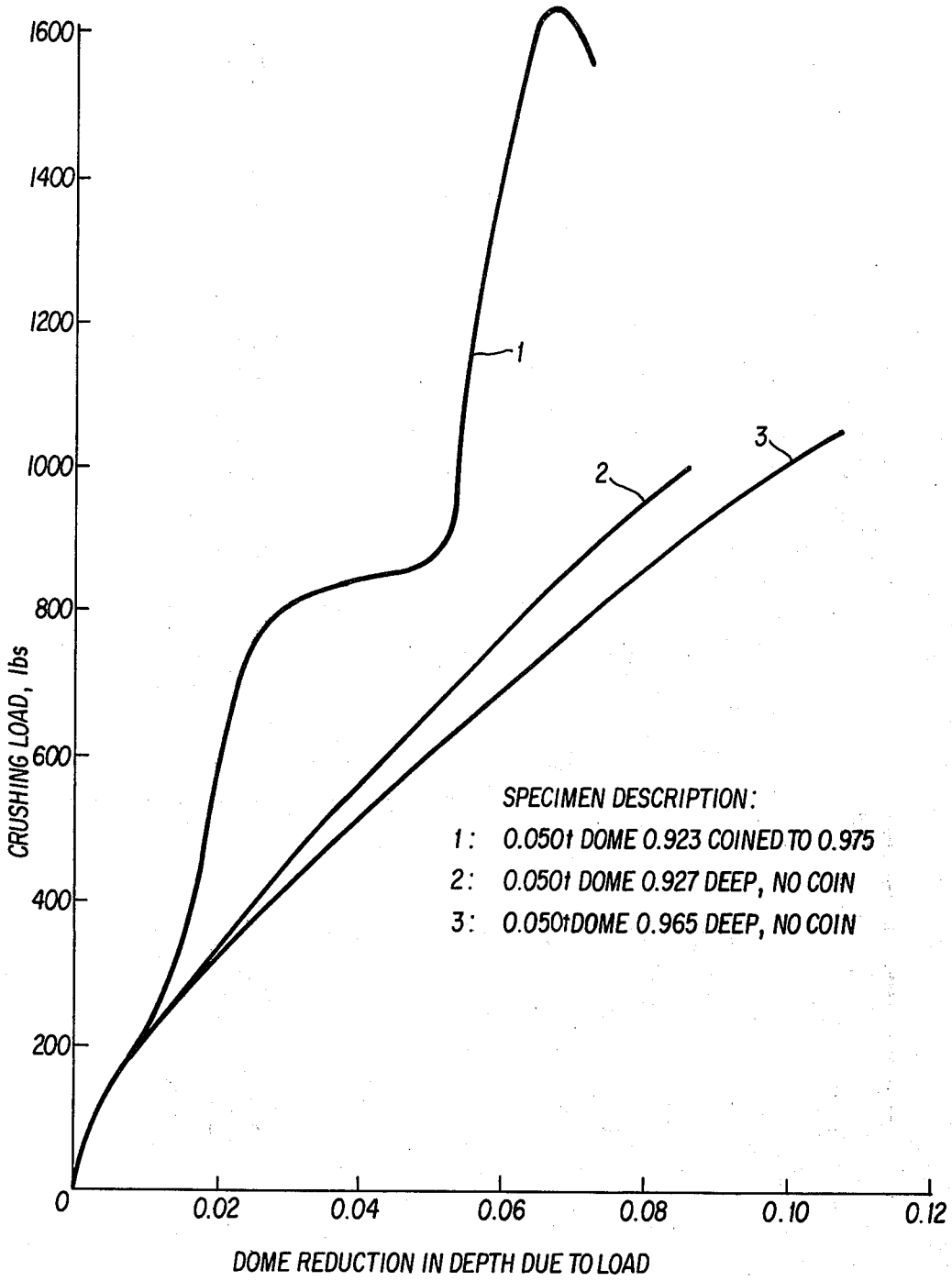
FIG. 14 is a graph illustrating a comparison of crushing load versus dome reduction due to load.

The resistance to crushing is the ability of the individual dome like projections in the structural panel to accept the localized compressive loads as would be experienced in an access floor panel without yielding locally or catastrophically. To demonstrate this improvement, individual domes were tested with and without the addition of the truncated cone. More particularly, as shown in FIG. 14, one curve represents the test results on a dome as used in U.S. Pat. No. 4,203,268, a second curve represents test results on a dome which was deeper dimensionally than that used in U.S. Pat. No. 4,203,268 and a third curve indicates test results of the present invention. It was then discovered that the present invention, despite being deeper with the addition of the truncated cone than the dome of U.S. Pat. No. 4,203,268, allows for much more desirable dome crushing characteristics than might have been expected.

As can be seen from the data as one typical example that the truncated cone reduces dome crushing of a dome to a similar initial depth at a crushing load of 700 lbs.. from 0.055" to 0.023" or a 139% improvement. Similarly for this example it can be seen that the truncated cone reduces dome crushing of a dome drawn to the same final depth to resist the tendancy to crush from 0.062" to 0.023" or a 170% improvement.

The foregoing specification illustrates preferred embodiments of the invention. However, concepts employed may, based upon such specification, be employed in other embodiments without departing from the scope of the invention. Accordingly, the following claims are intended to protect the invention broadly, as well as in the specific forms shown herein.

What is claimed as new and desired to be secured by Letters Patent of the United States is:

1. A sheet of structural material comprising:

a pattern of dome-like projections extending from the plane of said sheet and of which at least a major portion of the configuration of each dome-like projection is circular in plan view, said dome-like projections in the plane of said sheet being arranged in a geometric pattern that substantially limits the elongation of the material to the areas defined by the substantially circular configurations, at least one of said dome-like projections further comprising a truncated cone portion formed in a peak area thereof having a flattened uppermost planar surface parallel to the plane of said sheet, thereby increasing overall depth and resistance to crushing.

2. The sheet according to claim 1, further comprising a circular wall wherein said flattened uppermost surface of said truncated cone is connected to an adjacent upper portion of said dome-like projection from which said truncated cone is distended by said circular wall, said circular wall being substantially S-shaped in cross-section and developing a distinctness of contour which is established such that it provides additional depth and transfers compressive loads from said flattened uppermost planar surface of said truncated cone to a portion of the dome-like projection surrounding the base of said truncated cone to the extent that first yielding in compression occurs in said portion of said dome-like projection surrounding said truncated cone.

3. The sheet according to claim 2, wherein the ratio of the diameter of said flattened uppermost surface of said truncated cone to the diameter of said dome-like projection is from 1:16 to 1:2 inclusive.

4. The sheet according to claim 2 or 3, wherein the ratio of the overall depth from the lower surface of the truncated cone to said plane of said sheet to the diameter of said dome-like projection is from 1:4.28 to 1:2.14 inclusive.

5. The sheet according to claim 1, wherein the ratio of the diameter of said flattened uppermost surface of said truncated cone to the diameter of said dome-like projection is from 1:16 to 1:2 inclusive.

6. The sheet of structural material according to claims 1, 2, 5 or 3 in which said sheet is steel.

7. The sheet according to claim 1 or 5, wherein the ratio of the overall depth from the lower surface of the truncated cone to said plane of said sheet to the diameter of said dome-like projection is from 1:4.28 to 1:2.14 inclusive.

8. A sheet of structural material according to claim 1 further comprising a plurality of dome-like projections in the plane of the sheet arranged in a structurally strategic geometric pattern in which rows of equally spaced pairs of in-line dome-like projections are interwoven perpendicularly with other such rows of pairs in a basket weave fashion so that the portion of a centerline of a row of pairs of dome-like projections that lies between two aligned pairs bisects the pairs thereof in transverse rows and has sufficient pattern density to block straight lines of clear vision repeatedly in all directions across said sheet to form a one-piece rigid structural member capable of resistance to flexure and the portions of said member which are intermediately between said dome-like projections comprising continuous structural ribbon-like stress sections of fluctuating width and arcuate in plan view capable of optimizing stress resisting integrity.

9. The structural member according to claim 8 in which at least the majority of said dome-like projections in plan view are also combined in groups of four arranged in a rhombus pattern and adjacent rhombus patterns being positioned in a close perpendicular basket weave orientation and thereby locating said projections to repeatedly block said clear lines of vision as aforesaid.

10. The structural member according to claim 8 wherein all surfaces of said dome-like projections and the junctures therof with said intermediate structural stress sections in said original plane of said sheet are free from sharp angles or bends, whereby there are no areas of portions in said sheet which comprise corners or other shapes which normally tend to pucker or otherwise resist formation of smoothly stretched areas when formed from a planar sheet and subjected to shaping by dies.

11. A structural unit comprising a sheet of structural material according to claim 1 having formed therein a plurality of said dome-like projections of no greater thickness than said sheet, said dome-like projections in the plane of said sheet being arranged in a structurally strategic geometric pattern in which rows of equally spaced pairs of in-like dome-like projections are interwoven perpendicularly with other such rows of pairs in a basket weave fashion so that the portion of a centerline of a row of pairs of projections that lies between two aligned pairs bisects the pairs thereof in transverse rows and has sufficient pattern density to block all straight lines of clear vision repeatedly in all directions across said sheet, and the portions of said member which are intermediately between said dome-like projections comprising continuous structural ribbon-like sections of fluctuating width and arcuate in plan view, capable of optimizing stress-resisting integrity and said sections extending between the opposite edges of said sheet and being capable of maintaining resistance of the load stresses throughout said member and also capable of being maintained in the stated shape thereof when under stress by the circular configurations of said dome-like projections preventing movement thereof, said member being combined with a planar sheet fixedly secured to the flattened uppermost surface of the truncated cones of said dome-like projections, thereby providing a composite structural unit in which the optimization of support and resistance to crushing versus strength-to-weight ratio and structural efficiency is achieved, whereby when said planar sheet is subjected to loading said dome-like projections serve as arches to resist flexure and the truncated conical shape at the uppermost surfaces of said dome-like projections providing resistance to crushing thereof.

12. The structural unit according to claim 11, in which the pattern of said dome-like projection and the formation thereof from said sheet produces resistance to flexure in said structural unit which is substantially isotropic when said unit is penetrated by an opening of limited cross-section located inward from the edges thereof, thereby substantially retaining its resistance to flexure without directional weakness due to the resulting stresses in said unit when under load being redirected around said opening.

13. The structural unit according to claim 11 in which at least the majority of said dome-like projections in plan view are also combined in groups of four arranged in a rhombus pattern and adjacent rhombus patterns being positioned in close perpendicular basket weave orientation and thereby locating said dome-like projections to repeatedly block said clear lines of vision as aforesaid.

14. The structural unit according to claim 11 wherein said structural unit is of given finite size, the peripheral edge of the portions of said original planar material extending at right angles to said planar material to form a continuous bracing flange around the periphery of said structural unit, and means fixedly connecting said planar sheet to said bracing flange and the upper surfaces of the upper ends of said projections to form a rigid panel constructed to be supported selectively at the edges or corners thereof and capable of sustaining substantial uniform or concentrated loads without appreciable deflection or permanent set.

15. The rigid panel according to claim 14 in which said peripheral bracing flange has a greater transverse depth than the height of said dome-like projections and said peripheral bracing flange providing a perimeter of increased strength, said perimeter having one portion extending in the opposite direction to said projections relative to the original plane of said sheet and an additional portion extending in the same direction as said dome-like projections from said original plane of said sheet.

16. The rigid panel according to claim 14 wherein the outer extremities of said edge portions of said formed bracing flange are also bent outward at a right angle to said flange to form a peripheral lip parallel to the plane of said intermediate portions of said member between said dome-like projections, and means fixedly connecting said peripheral lip to said planar top sheet.

17. The structural unit according to claim 11 in which said sheet of structural material and said planar sheet are steel.

18. The structural unit according to claim 17 in which said planar sheet is secured to said outer terminal ends of said dome-like projections by welding.

19. The sheet according to claim 1, further comprising a circular wall interconnecting said at least one of said dome-like projections and said flattened uppermost planar surface of said truncated cone for developing a distinctness of contour which is established so as to provide additional depth and transfer compressive loads from said flattened uppermost planar surface of said truncated cone to a portion of the dome-like projection surrounding the base of said truncated cone to the extent that first yielding in compression occurs in said portion of said dome-like projection surrounding said truncated cone.

20. The sheet according to claim 19, wherein said circular wall is substantially S-shaped in cross-section.

* * * * *